US006629662B2

(12) United States Patent
Howden et al.

(10) Patent No.: US 6,629,662 B2
(45) Date of Patent: Oct. 7, 2003

(54) METHOD AND APPARATUS FOR ROLLING CARPET

(75) Inventors: Ike Howden, Dalton, GA (US); Will Creswell, Dalton, GA (US); Bob Creswell, Dalton, GA (US); David Clark, Dalton, GA (US)

(73) Assignee: Tuftco Finishing Systems, Inc., Dalton, GA (US)

( * ) Notice: Subject to any disclaimer, the term of this patent is extended or adjusted under 35 U.S.C. 154(b) by 0 days.

(21) Appl. No.: 09/885,428

(22) Filed: Jun. 20, 2001

(65) Prior Publication Data

US 2002/0195516 A1 Dec. 26, 2002

(51) Int. Cl.[7] ..... B65H 19/28; B65H 75/28; B65H 19/30

(52) U.S. Cl. ..... 242/532.5; 242/532.3; 242/533.1; 242/527.5; 242/542.1; 242/586.5

(58) Field of Search ..... 242/532.5, 532.1, 242/532.3, 532.7, 533.1, 527.5, 527.6, 527.7, 542.1, 541.5, 541.6, 582, 583, 586.5, 542, 542.2

(56) References Cited

U.S. PATENT DOCUMENTS

| | | | | | |
|---|---|---|---|---|---|
| 925,425 | A | * | 6/1909 | Casler | 242/586.5 |
| 2,573,188 | A | * | 10/1951 | Dyken | 242/541.6 |
| 2,714,493 | A | * | 8/1955 | Gramp | 242/586.5 |
| 3,720,381 | A | * | 3/1973 | Rehme et al. | 242/533.1 |
| 3,782,664 | A | * | 1/1974 | Alberto | 242/532.1 |
| 3,850,381 | A | * | 11/1974 | Moore | 242/542.2 |
| 4,105,169 | A | * | 8/1978 | Alinder et al. | 242/532.5 |
| 4,256,269 | A | * | 3/1981 | Feighery et al. | 242/541.5 |
| 5,022,597 | A | * | 6/1991 | Morizzo | 242/533.1 |
| 5,105,944 | A | * | 4/1992 | Ingalls et al. | 242/532.3 |
| 5,222,679 | A | * | 6/1993 | Dropczynski et al. | 242/532.3 |
| 5,257,748 | A | * | 11/1993 | Morizzo | 242/541.5 |
| 5,273,226 | A | * | 12/1993 | Dropczynski | 242/532.3 |
| 5,393,009 | A | * | 2/1995 | Neri | 242/559.4 |
| 5,577,684 | A | * | 11/1996 | Dropczynski et al. | 242/542 |
| 5,944,279 | A | * | 8/1999 | Dueck | 242/527.5 |
| 6,086,010 | A | * | 7/2000 | Kayser | 242/532.3 |

FOREIGN PATENT DOCUMENTS

| | | | | |
|---|---|---|---|---|
| JP | 62-279025 | * | 12/1987 | 242/532.5 |
| JP | 6-16342 | * | 1/1994 | 242/532.5 |
| JP | 6-179551 | * | 6/1994 | 242/532.1 |

OTHER PUBLICATIONS

Tuftco High Speed Semi–Automatic Roll–up Machine Brochure ©2000.

* cited by examiner

*Primary Examiner*—John M. Jillions
(74) *Attorney, Agent, or Firm*—Douglas T. Johnson

(57) ABSTRACT

A carpet rolling machine for quickly and efficiently rolling carpet around a core without causing damage to the carpet. The machine includes a moveable dispenser for applying an adhesive flap to the core prior to winding the carpet around the core. The leading edge of the carpet is positioned between the flap and the core so that it may attach to the adhesive on the interior surface of the flap. Once the leading edge of the carpet is properly positioned, the carpet is wound around the core by a roll up.

12 Claims, 15 Drawing Sheets

STOP

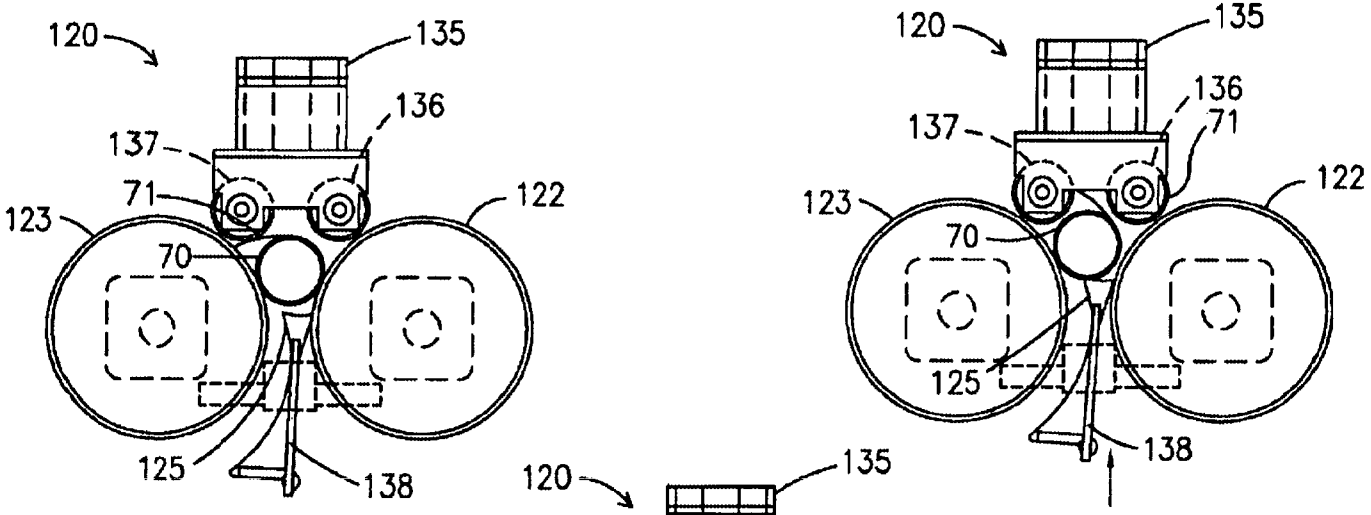
Fig. 12a
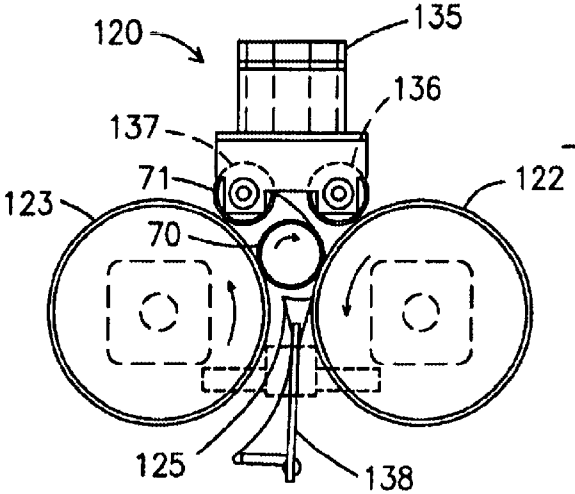
Fig. 12b
Fig. 12c

METHOD AND APPARATUS FOR ROLLING CARPET

FIELD OF THE INVENTION

This invention relates to a method and apparatus for winding carpet around a core with a flap, into a roll and particularly to a method and apparatus for automatically feeding carpet through a carpet rolling machine which places an adhesive flap on a core and places the leading edge of the carpet under the flap prior to winding the carpet into a roll around the core. The carpet rolling machine of this invention can be used to roll carpet on a core as it is manufactured, such as from a final treatment machine after a manufacturing process, or as carpet is fed from a large master roll on smaller rolls in a distribution warehouse or the like.

BACKGROUND OF THE INVENTION

In the manufacture of carpet, the finished product is generally wound into a roll. Broadloom carpet, typically manufactured in twelve to sixteen feet widths, is wound about a paperboard core to preclude bending of the carpet and for handling purposes, the paper board core being left within the rolled carpet.

It is known in the art to use an automatic rolling machine to roll carpet around a core by feeding carpet into a machine which captures the carpet and rolls it around the core. After three or four layers of carpet are rolled around the core, the carpet begins to grip and is eventually tightly held around the core. This process crushes the initial, more loosely wound layers of carpet around the core, and results in creases and malformations which permanently damage the lead end of the carpet. The damaged carpet at the beginning of each roll typically results in loss of carpet to the mill, or wholesale purchaser, because master carpet rolls are commonly sent to distribution centers where the carpet may be re-rolled into smaller rolls for individual orders. Master rolls may sit on racks for months before they are exhausted. This commonly results in a total loss of the first ten to twenty feet of carpet on each original large master roll. In addition, the beginning of each smaller roll may also be crushed and damaged, multiplying the amount of wasted carpet.

In order to avoid the problems associated with automatic rolling machines, such as the loss of carpet due to crushing, it is known to hand start carpet rolling machines by using a pre-manufactured core with a flap and manually feeding the carpet under the flap. The flap protects the carpet from creases and damage to the initial layers around the core. However, hand starting carpet rolling machines is not efficient or economical as it requires time and the labor of at least two or three individuals to hand start the carpet rolling process on each new roll. No prior art machine for accomplishing the same purpose is known to the applicant.

It is also known in the art to hand roll carpet on cores, both with and without flaps, in order to avoid the problems associated with creased or malformed carpet at the end of a roll of carpet. However, this process has disadvantages in that it typically requires two to three individuals who must manually insert the carpet under the flap of the core. Furthermore, once the roll is hand started by manually putting carpet under the flap of the core, the edges must be guided to keep the carpet from telescoping off the end of the roll. Both processes are labor and cost intensive.

Another problem associated with the use of automatic carpet rolling machines is that when the carpet is fed into the rolling machine in a particular orientation, i.e. pile-in or pile-out, the machine can only form a roll with the pile directed inwardly or outwardly as the case may be. It is desirable that regardless of the original orientation of the carpet, a rolling machine should be able to form either a pile-in or pile-out roll, to enable the better form of roll to be selected with regard to the properties of the pile and backing of the carpet.

SUMMARY OF THE INVENTION

The present invention recognizes and addresses the foregoing disadvantages, and others, of prior art construction and methods.

Accordingly, it is a primary object of the present invention to provide a carpet rolling machine which attaches a flap to a core so that carpet can be automatically fed into the carpet rolling machine with that the leading edge of the carpet is gripped or adhered between the flap and the core, and the carpet is rolled around the core without damaging any significant amount of carpet.

It is another object of the present invention to provide a carpet rolling machine having a simple and effective means for directing the leading edge of carpet for forming either a pile-in or pile-out carpet roll. It is a further object of the present invention to provide a carpet rolling machine having an arrangement of movable deflectors for guiding the leading edge of carpet to a flap on a core for forming a roll of carpet having either a pile-in or pile-out orientation.

It is yet a further object of the present invention to provide a method and apparatus for attaching an adhesive flap on a core and feeding carpet under the adhesive flap prior to rolling carpet about the core.

Accordingly, the present invention provides a carpet rolling machine in one embodiment comprising: a storage magazine having a storage magazine top deck with a conveyor belt that indexes master carpet rolls toward an elevator which carries the carpet to an unroll cradle. The unroll cradle has two rollers to unroll the carpet into a squaring table which measures and ultimately cuts the carpet with a dual shear cross-cutter. Located above the squaring table is a dispenser which dispenses cores. Once an appropriate core is dispensed, the core is transported to core placement arms which hold and center the core. A flap applicator moves across the length of the core applying a paper flap to the core with an adhesive strip.

After the flap has been attached to the core, the core is transported to a precise position on the roll up. The unroll cradle feeds the leading edge of the carpet across the squaring table and into the roll up so that the leading edge is forced to a position between the core and the flap. With the leading edge of the carpet between the core and flap, the roll up winds the carpet around the core. After the carpet has been fully wound around the core, it may be transferred to an accumulation table to be wrapped and moved away, ready for distribution.

BRIEF DESCRIPTION OF THE DRAWINGS

The particular features and advantages of the invention as well as other objects will become apparent from the following description taken in connection with the accompanying drawings in which:

FIG. 9(*h*) shows a side view of the flap applicator of the present system as it completes one cycle of flap application;

FIG. 10(*a*) shows a side view of the flap applied to the core so that the mouth of the flap faces the accumulation tables resulting in carpet that is rolled pile-in;

FIG. 10(*b*) shows a side view of the flap applied to the core so that the mouth of the flap faces the squaring table resulting in carpet that is rolled pile-out;

FIGS. 11(*a–i*) are side views of the roll up of the present invention showing one cycle of rolling a carpet around a core with a flap, showing the carpet rolled pile-in;

DETAILED DESCRIPTION OF THE PREFERRED EMBODIMENTS

Reference will now be made in detail to the presently preferred embodiment of the invention. It will be apparent to those skilled in the art that modifications and variations can be made in the present invention without departing from the scope or spirit thereof. Thus, it is intended that the present invention covers such modifications and variations as come within the scope of the appended claims and their equivalents, including the rolling of other flexible materials in addition to carpet.

Figure 1:
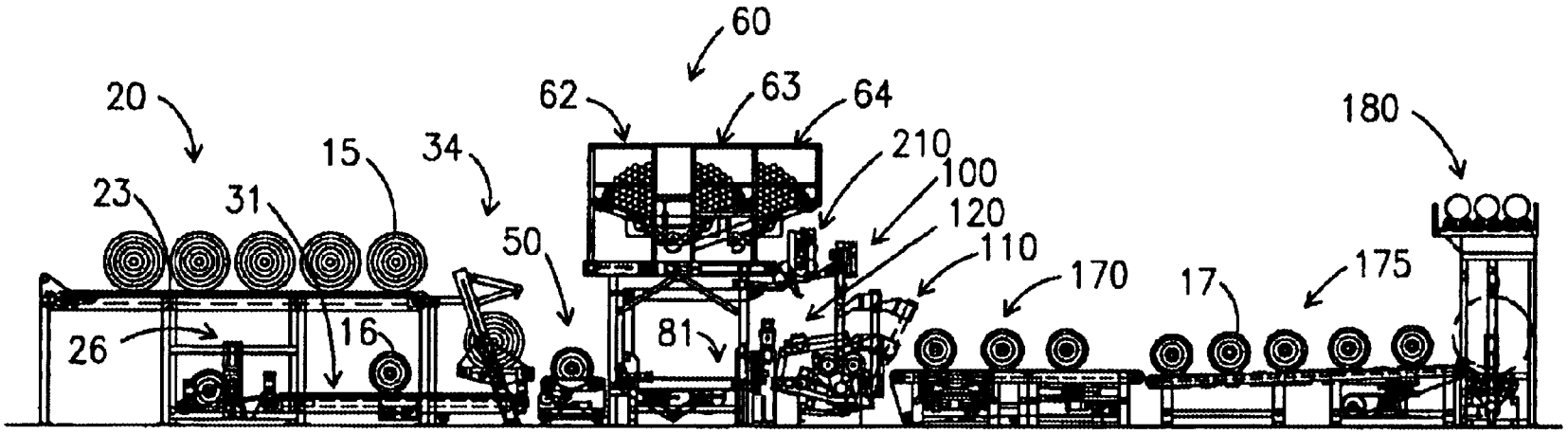
FIG. 1 is a side elevation view of a carpet rolling system constructed in accordance with the principals of the present invention.
Figures 5, 6A:
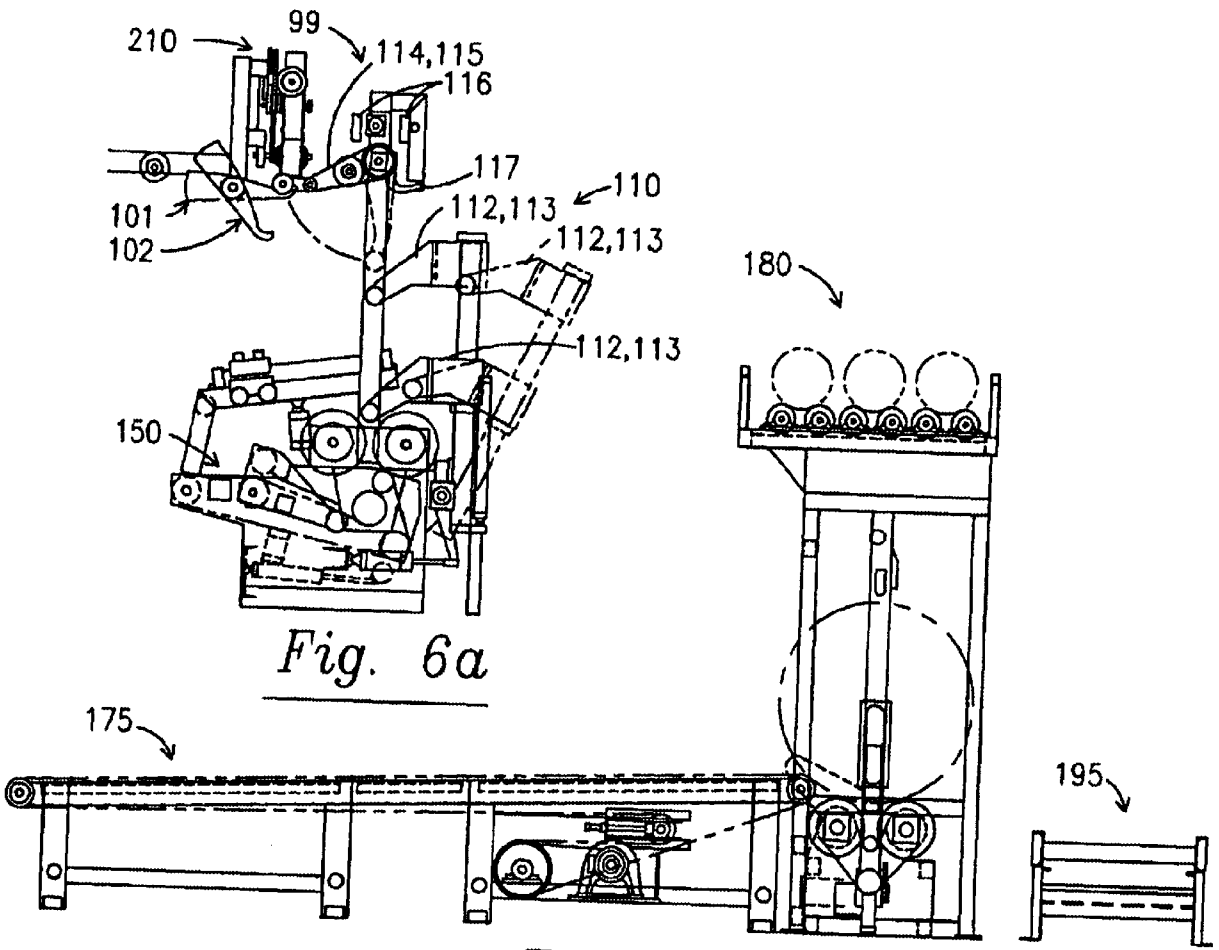
FIG. 5 is an enlarged side elevation view illustrating the second accumulation table, wrapping station and takeaway conveyor of the carpet rolling system of FIG. 1.
FIG. 6*a* is a side elevation view of the flap application and roll up system showing the relative motions of the core support arms, core holding arms and the core placement arms of the carpet rolling machinery of FIG. 1 in isolation.

Referring now to the drawings, FIG. 1 depicts a complete carpet rolling and cutting apparatus with storage magazine 20; top deck 23; taping station 26; bottom magazine rack 31; elevator 34; unroll cradle 50; core dispensing system 60; core dispensers 62, 63 and 64; squaring table 81; flap core positioning system 100; anti-telescoping system 110; flap applicator 210; roll up 120; accumulation tables 170, 175; wrapping station 180; and take away conveyor 195, shown in FIG. 5. This configuration is typical for a carpet distribution warehouse, where warehoused master rolls 15 of carpet may be retrieved by pole truck and placed on the top deck 23 of the storage magazine 20. The master rolls 15 are used to offload smaller rolls for individual customers, and the partially used master rolls 16 are returned to bottom magazine rack 31 to again be warehoused by pole truck. In a carpet finishing facility, the carpet exiting from the apparatus applying and curing the backing might be fed directly into the squaring table 81.

Figure 2:
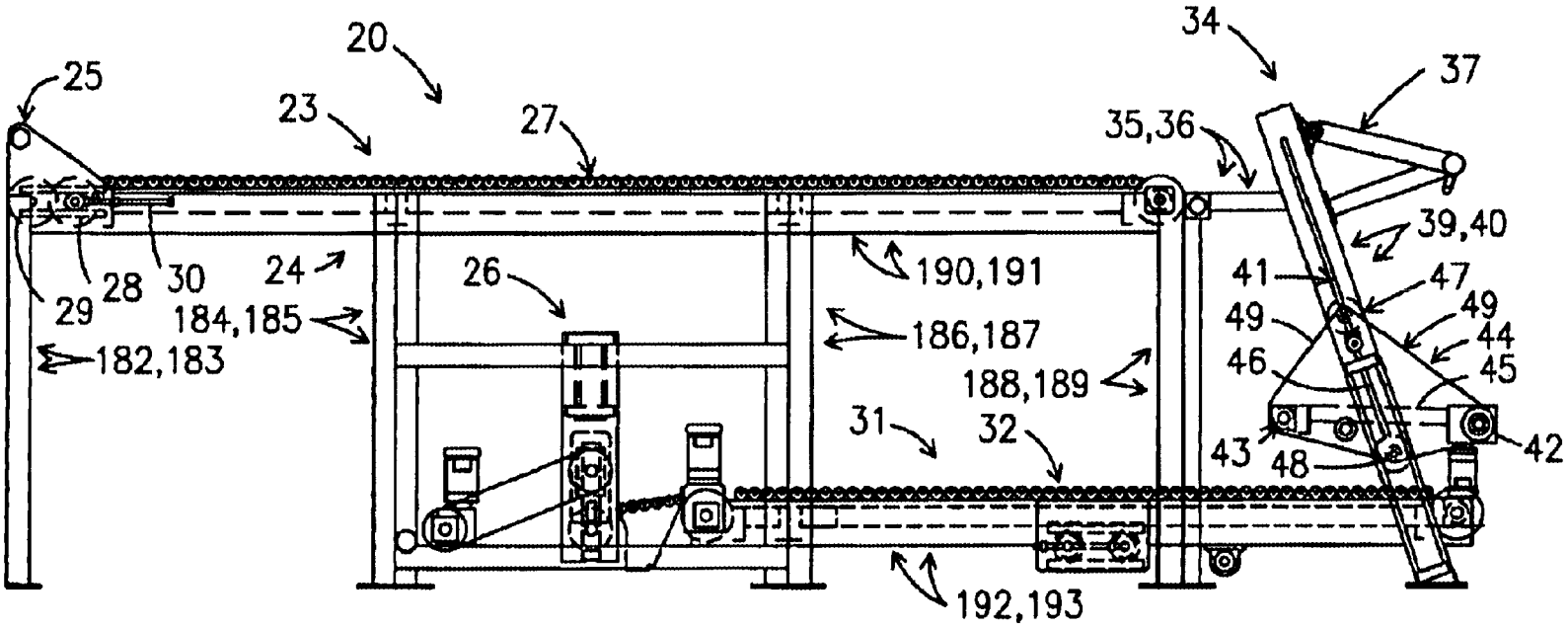
FIG. 2 is an enlarged side elevation view, illustrating a portion of the carpet rolling system of FIG. 1 and depicting the storage magazine, elevator and storage magazine taping station.

The storage magazine 20, elevator 34 and taping station 26 are illustrated in greater detail in FIG. 2. The storage magazine 20 is supported by a frame assembly 24 consisting of vertically extending posts 182, 183, 184, 185, 186, 187, 188 and 189, supporting and mounted to top horizontally extending beams 190 and 191, and bottom horizontally extending beams 192 and 193. The top horizontally extending beams 190 and 191 support the storage magazine top deck 23 and the bottom horizontally extending beams 192 and 193 support the storage magazine bottom deck 31. Master carpet rolls 15, shown in FIG. 1, are loaded on to a top deck conveyor belt 27 located on the top deck 23 of the storage magazine 20. The top deck conveyor belt 27 automatically indexes master carpet rolls 15 forward to the elevator 34. The conveyor belt 27 of the top deck is powered by a conveyor belt driving mechanism 29 which can be any driving mechanism known in the art. Conveyor belt adjusting screw 30 is used to maintain the proper tension, via a belt take-up mechanism 28, of top deck conveyor belt 27. A stop 25 mounted on the top deck 23 above the conveyor belt take-up mechanism 28 prevents the master rolls 15 from rolling off the top deck conveyor belt 27.

The elevator 34 consists of two elevator columns 39 and 40. The elevator columns 39 and 40 are mounted near their top end to a pair of horizontal supports 35 and 36 extending perpendicular to the frame assembly posts 188 and 189 and horizontally extending away from top beams 190 and 191. The elevator columns 39 and 40 are mounted to the bottom horizontal extension beams 192 and 193 near their lower end and anchored to the ground. Specifically, elevator column 39 is mounted near its top end to horizontal support 35 (horizontally extending from frame assembly post 188) and near its lower end to bottom horizontal extension beam 192. And, elevator column 40 is mounted near its top end to horizontal support 36 (horizontally extending from frame assembly post 189) and near its lower end to bottom horizontal extension beam 193. Each of the elevator columns 39 and 40 are slanted toward the top deck 23 and mounted to the horizontal supports 35 and 36 by ending the horizontal supports 35 and 36 in an angular cross section to mate with the load bearing face of the elevator columns 39 and 40. The bottom surface of the elevator columns 39 and 40 are also ended in a slanted fashion in order to facilitate a slant toward the top deck 23.

Elevator columns 39 and 40 also have cavities which house the supporting structures for a carriage 44. The elevator 34 has a carriage 44 which is supported by a top bearing roll 47 and bottom bearing roll 48 inside the cavity of each of the elevator columns 39 and 40. The carriage 44 comprises a conveyor drive 42 and an idler roller 43 at opposite ends, connected by a carriage conveyor belt 45 which holds master carpet rolls 15 as they are carried down on the carriage 44 of the elevator 34. The top bearing rolls 47 and the bottom bearing rolls 48 are connected to the conveyor drive 42 and the idler roller 43 by means of connecting arms 49. The elevator actuators 46 move the carriage 44 up and down the elevator columns 39 and 40 by applying force to the top bearing rolls 47. The carriage 44 is guided between the elevator columns 39 and 40, by bearing rolls 47, 48, which direct the travel of the carriage 44 between the top magazine rack 23, at a forward slant downward to a location slightly above and intermediate to the bottom magazine rack 31 and behind the unroll cradle 50, shown in FIGS. 1 and 3. In operation, the carriage 44 lowers master carpet rolls 15 from the top magazine rack 23 to a position behind and slightly above the unroll cradle 50. During motion of the carriage 44 a pivot roll stop 37 prevents the master carpet 15 from rolling off of the carriage 44. Consequently, the master roll 15 is transferred from the carriage conveyor belt 45 to the cradle mouth 57 of the unroll cradle 50, shown in FIG. 3. The carriage 44 then returns to its home position located next to the top deck conveyor belt 27 of the storage magazine 20 to receive the next master carpet roll 15.

Also shown in FIG. 2 is a storage magazine taping station 26 located below the storage magazine top deck 23. The taping station 26 is located next to the storage magazine bottom deck 31 and receives partially used master rolls 16, shown in FIG. 1, from the bottom deck conveyor belt 32. The taping station 26 functions by receiving a partially used master roll 16 of carpet and retaping it for later use. The partially used master rolls 16 reach the taping station 26 when the unroll cradle 50, shown in FIG. 3, is moved rearward and the cradle mouth 57 is tilted back so that the partially used master roll 16 is transported to bottom deck conveyor belt 32.

Figure 3:
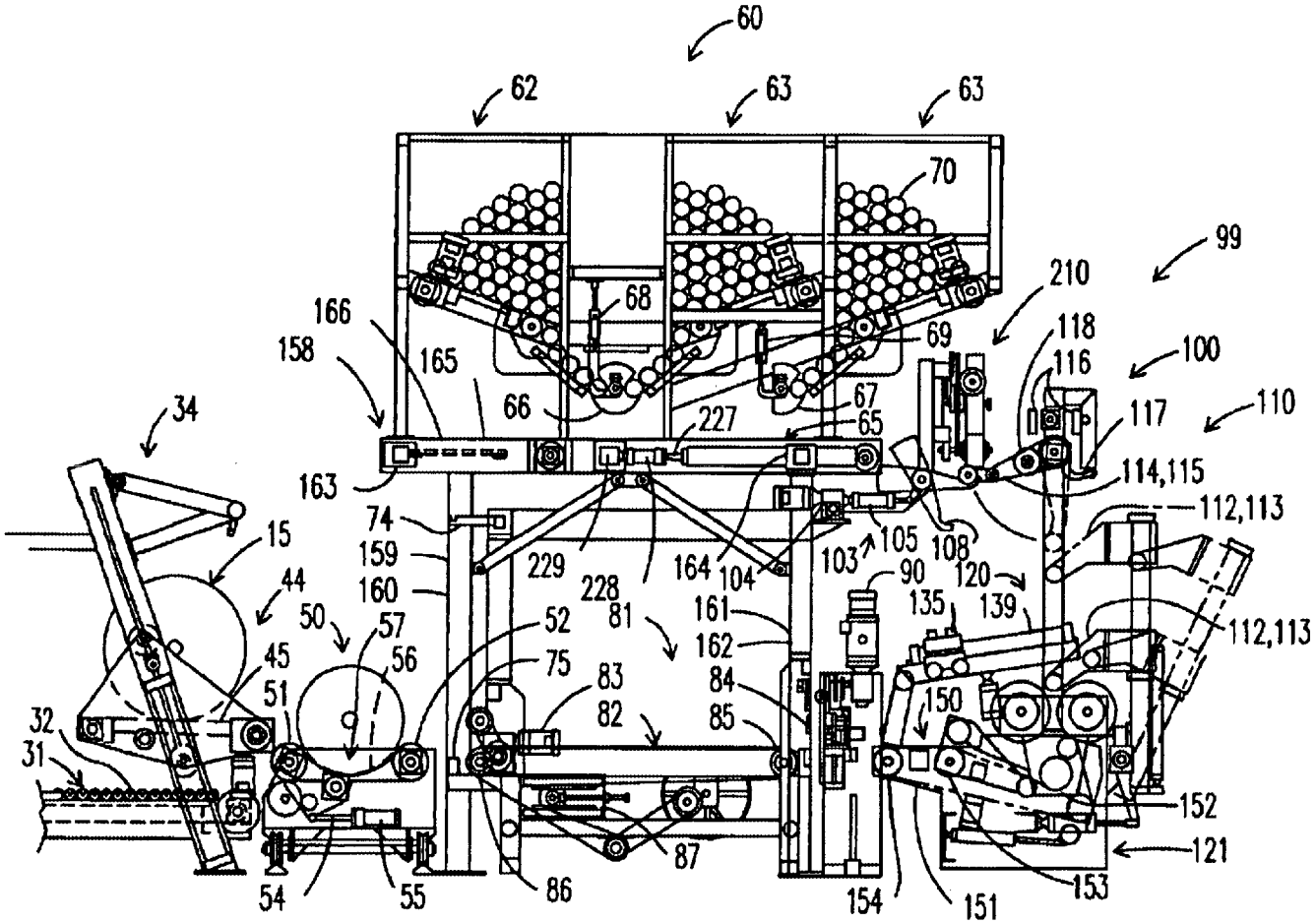
FIG. 3 is an enlarged side elevation view illustrating a portion of the carpet rolling system of FIG. 1 and depicting the unroll cradle, squaring table, core dispensers, flap core position system and roll up.

FIG. 3 shows the elevator 34, unroll cradle 50, the anti-telescoping system 60, the squaring table 81, dual sheer cross cutter 90 and flap application and roll up system 99. Flap application and roll up system 99 comprises flap core positioning system 100, anti-telescoping system 110, roll up 120, feeding mechanism 150 and flap applicator 210. All of the subassemblies of flap application and roll up system 99, except flap applicator 210, are supported by roll up frame 121.

In operation, a master roll 15 is transferred from the carriage conveyor belt 45 of the elevator 34 to the cradle mouth 57 of the unroll cradle 50. The unroll cradle 50 holds and dispenses the master roll 15 to the squaring table 81. The unroll cradle 50 comprises first and second unroll cylinders, 51 and 52, connected by a cradle conveyor belt 56 upon which the master roll 15 sits. When the first and second unroll cylinders 51 and 52 rotate, the master roll 15 unwinds, thereby feeding carpet from the master roll 15 into the squaring table 81. When a partially used master roll 16 is no longer required, the actuating mechanism 53 of the unroll cradle 50 is retracted so that the cradle conveyor belt 56 dispenses the partially used master roll 16 on to the bottom deck conveyor belt 32. More specifically, when the actuator 55 of the actuating mechanism 53 is retracted it pulls the actuating arm 54 back, which in turn forces the first unroll cylinder 51, located next to the elevator 34, down so that the cradle mouth 57 slopes toward the bottom deck 31 of the storage magazine 20, forcing the partially used master roll 16 to move out of the unroll cradle 50 and onto the bottom deck conveyor belt 32. This action occurs only when the carriage 44 of the elevator 34 is in the up or top position so that the path is not blocked. The bottom deck conveyor belt 32 carries the partially used master roll 16 to the automatic taping station 26 where it is taped and prepared for storage.

As the master supply roll is unwound by the unroll cradle 50 the carpet is fed pile-up forward on the squaring table 81. The leading edge of the carpet first passes through top center line guide 74 and bottom center line guide 75, each having optical sensors which determine the position of the carpet and guide the carpet to ensure its proper alignment. If the carpet is not aligned and squared with the machine, the carpet is aligned by shifting unroll cradle 50 in or out. After passing through the top and bottom center line guides 74 and 75, the carpet passes through the squaring table 81 via the squaring table conveyor belt 82. The squaring table conveyor belt 82 is driven by squaring table conveyor belt drive 83 which drives conveyor belt drive roller 86 while conveyor belt idler roller 85 is free to rotate on its own. The feed length of the carpet passing through the squaring table 81 to roll up 120 is measured by a measuring wheel 224 located on the squaring table 81. Once the desired amount of carpet has been dispensed, a dual shear cross cutter 90 is used to cut the carpet while a hold down bar 84 firmly holds the carpet.

Core dispensing system 60 is supported by core dispensing frame 158. Core dispensing frame 158 includes core dispensing posts 159, 160, 161 and 162 which are mounted to the floor at their bottom end and support core dispensing longitudinal beams 165 and 166 at their top end. Core dispensing lateral beams 163 and 164 are secured at each end to the side face of core dispensing longitudinal beams 165 and 166. Core dispensers 62, 63 and 64 are mounted above the squaring table 81 to the core dispensing frame 158. The core dispensers 62, 63 and 64 may house cores having different lengths, diameters, or other characteristics, and cores are dispensed on to a core dispenser conveyor belt 65 via selector dials 66 or 67. The operator selects from the available core lengths or types based on the width or type of carpet being rolled. When an operator chooses an appropriate core, the proper selector dial actuator 68 or 69 is activated to rotate the selector dials 66 or 67, respectively. This ensures that the appropriate core is deposited on core dispenser conveyor belt 65. Consequently, the core 70 is transferred via the core dispenser conveyor belt 65 to the core support arms 101 and 102 which hold the core 70 in an impression or nook 108 at their curled ends.

Figure 10A:
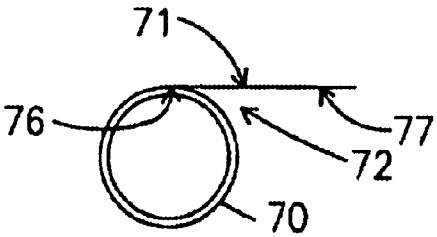
Figure 10B:
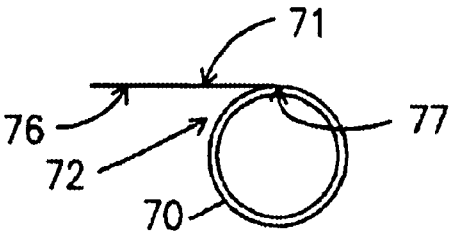

Flap applicator 210 is attached to core dispensing frame 158 via a pair of positioning actuators 228. The positioning actuators 228 are connected to the core dispensing longitudinal beams 165 and 166 at a positioning actuator bracket 229. The position of the flap applicator 210 above the core support arms 101 and 102 which hold the core 70 determines the orientation of the attachment of the flap 71 to the core 70, ultimately determining whether the carpet is rolled pile-in or pile-out. This is because if the flap 71 is applied to the core 70 so that the mouth of the flap 72 faces downstream toward the accumulation tables 170 and 175, as shown in FIGS. 10(*a*) and 11(*a–f*), the carpet will be rolled pile-in. But, if the flap 71 is applied to the core 70 so that the mouth of the flap 72 faces upstream toward the squaring table 81, as shown in FIGS. 10(*b*) and 12(*a–f*), the carpet will be rolled pile-out. In order to accomplish attachment of the flap 71 to the core 70 so that the mouth of the flap 72 faces the accumulation tables 170 and 175, the flap applicator 210 is positioned above the core 70 so that the paper 225 extending from the roll of flap 218 lies slightly toward the accumulation tables 170 and 175. This is accomplished by extending the actuators 228 which push the linkages 227 attached to frame and track attachment arms 226 toward the accumulation tables 170 and 175. This attaches upstream adhesive strip 76, shown in FIG. 8, to the top of core 70.

In order to attach the flap 71 to the core 70 so that the mouth of the flap 72 faces the squaring table 81, the flap applicator 210 is positioned above the core 70 so that the paper 225 extending from the roll of flap 218 lies slightly toward the squaring table 81. This is accomplished by retraction of actuators 228 which in turn pulls the linkages 227 away from the accumulation tables 170 and 175. This attaches downstream adhesive strip 77, shown in FIG. 8, to the top of core 70.

After flap 71 is applied to the selected core 70, the core 70 is positioned in the roll up 120 so that carpet fed from the squaring table 81 into the roll up area goes under the attached flap 71 in the mouth of the flap 72, and the carpet can be wound onto the core 70.

Figure 4:
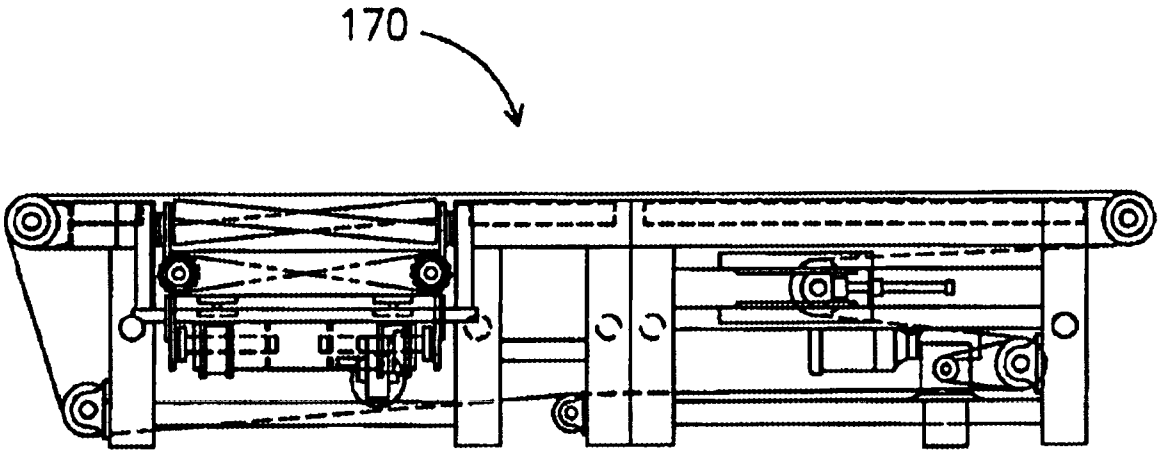
FIG. 4 is an enlarged side elevation view illustrating the first accumulation table of the carpet rolling system of FIG. 1.

FIGS. 4 and 5 are enlarged and isolation views of accumulation tables 170, 175 respectively; a wrapping station 180; and a take away conveyor 195. These devices are known in the art and used to hold, position and wrap the carpet rolls 17 formed in roll up 120, and convey these rolls on to be removed for transport or storage.

Figure 6B:
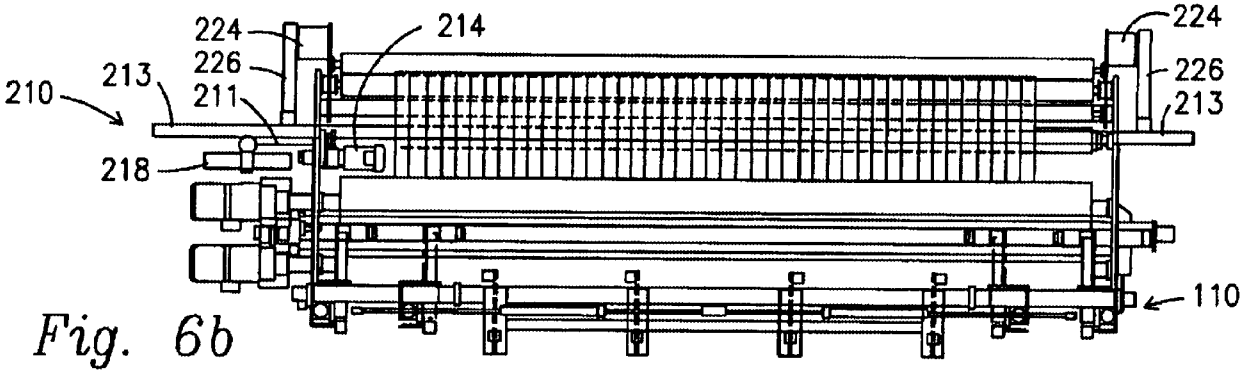
FIG. 6*b* is a top view of the flap application and roll up system of the carpet rolling machine of FIG. 1.
Figure 6C:
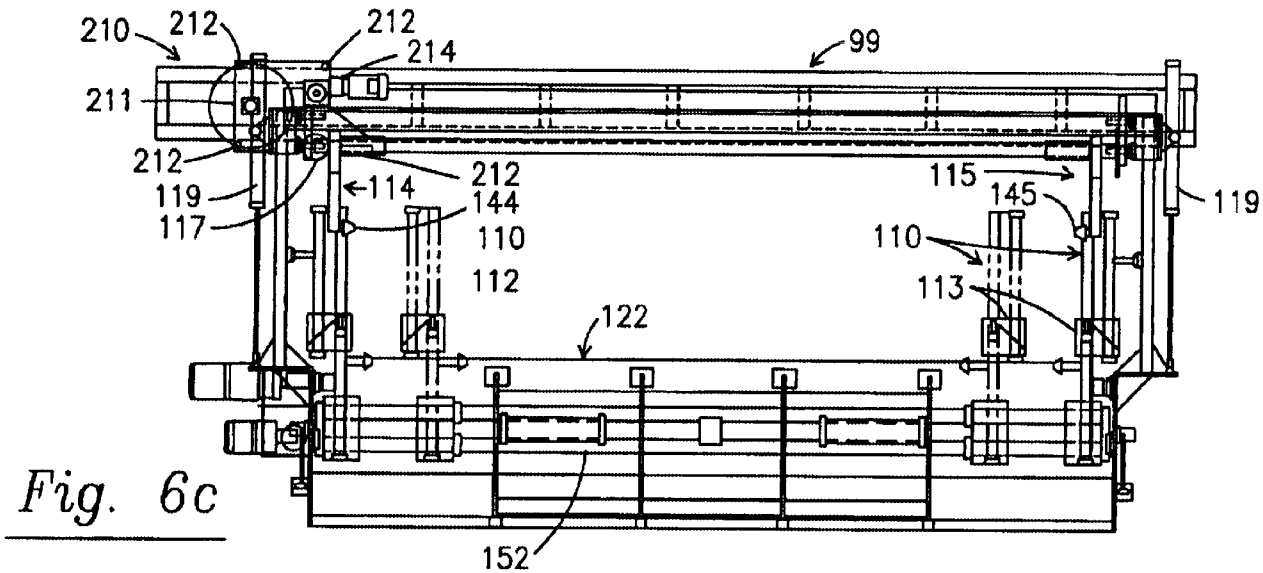
FIG. 6*c* is a front view of the flap application and roll up system of the carpet rolling machine of FIG. 1.
Figure 7B:
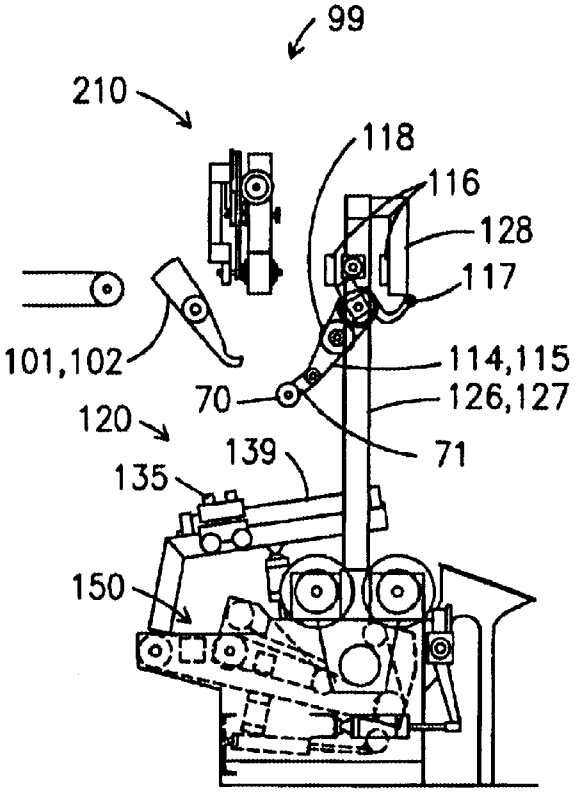
FIGS. 7(*a–d*) is a side view of the flap core positioning system of the present invention showing the relative motions during one cycle of the flap core positioning system.
Figure 7A:
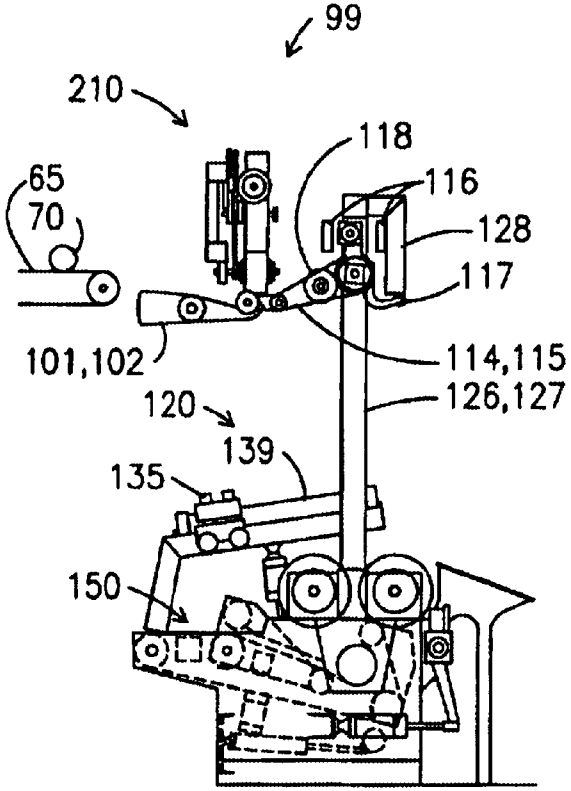
Figure 7D:
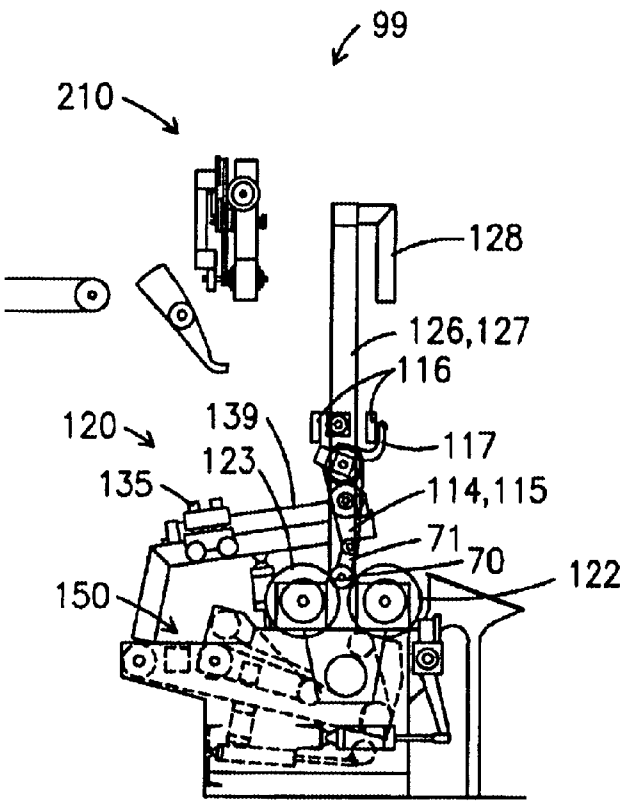
Figure 7C:
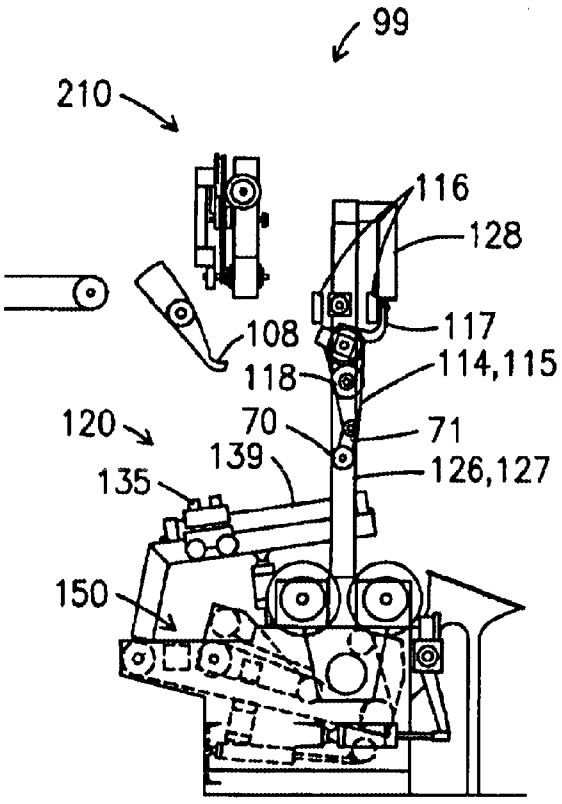

FIGS. 6*a*–6*c* show the details of the flap application and roll up system 99 which comprises flap core positioning system 100, anti-telescoping system 110, roll up 120, feeding mechanism 150 and flap applicator 210. FIG. 6*a* is a side end view of the flap application and roll up system 99, showing the flap core positioning system 100 with the relative motion of the core support arms 101 and 102 and core placement arms 114 and 115, as the core 70 has a flap applied and is moved downward to the roll up 120. This view also shows the anti-telescoping system 110 and the relative motion of anti-telescoping arms 112 and 113, which move into position on either side of the core 70 in the roll up 120. FIG. 6*b* provides a top view of the flap application and roll up system 99 showing the anti-telescoping system 110 and flap applicator 210. This view shows the attachment of flap applicator 210 to the core dispensing frame 158 via the frame and track assembly 213. The position of the frame and track assembly 213 is adjusted back and forth through actuator 228. FIG. 6*c* shows the front end view of the flap application and roll up system 99 including the anti-telescoping system 110 and flap applicator 210.

FIGS. 7(*a*–*d*) illustrate one cycle of the flap core positioning system 100. Flap core positioning system 100 comprises core support arms 101 and 102 mounted to the end of the core dispenser conveyor belt 65. Flap core positioning system 100 also comprises core placement head 116 having core placement arms 114 and 115 pivotally mounted beneath it with respect to guide posts 126 and 127. The core placement arms 114 and 115 have core placement arm cones 144 and 145, shown in FIGS. 6(*b*) and 9(*b*)(*c*) and (*e*), mounted at each end. The core placement arm cones 144 and 145 are inserted inside the hollow ends of the core 70 to center the core 70 and hold it in position.

FIG. 7(*a*) illustrates core dispenser conveyor belt 65 delivering a core 70 to core support arms 101 and 102. The core 70 rolls off of the core dispenser conveyor belt 65 onto the core support arms 101 and 102 and rolls down the core support arms 101 and 102 until it comes to a rest in the nook 108 of the core support arms 101 and 102. As the core 70 sits in the nook 108 of the core support arms 101 and 102, core placement arms 114 and 115 close in towards the ends of core 70. The core placement arm cones 144 and 145 at the end of core placement arms 114 and 115 enter into the hollow ends of core 70 to hold core 70 in place and properly center core 70 during the flap application cycle. At this time, the flap application process takes place.

As shown in FIG. 7(*b*), after the flap 71 has been placed on the core 70, the core support arms 101 and 102 rotate out of the way, leaving core 70 with flap 71 attached. At this point, the core 70 is supported on core placement arms 114, 115 via the core placement arm cones 144 and 145 inserted in the hollow ends of the core 70. With the core support arms 101 and 102 out of the way and the core placement arm cones 144 and 145 of core placement arms 114, 115 holding the core 70 with flap 71 attached, core placement head 116 is lowered. This correspondingly lowers the core placement arms 114 and 115 holding the core 70 with the flap 71 attached. A cam arm 117 allows the core placement arms 114 and 115 to rotate down to a position above the roll up 120 as the core placement head 116 descends by resting and pushing on guide post back stop 128. A chain and sprocket set 118 which is attached to the core placement head 116 counter rotates the ends of core placement arms 114, 115 and prevents the core 70 with flap 71 changing rotational position, although the core placement arms 114 and 115 rotate relative to the core placement head 116.

FIG. 7(*c*) shows the continued downward movement of the core placement head 116, the continued counter clockwise rotation of the core placement arms 114 and 115, and the cam arm 117 which also prevents the core placement arms 114 and 115 from going past bottom center directly above the roll up 120. Again, the chain and sprocket set 118 continue to keep the core 70 and flap 71 from changing rotational position.

As shown in FIG. 7(*d*), the continued movement downward of the core placement head 116 is stopped at a predetermined location above and between drive roll 122 and tuck roll 123 of the roll up 120. At this point the core placement arms 114 and 115 open by moving away from one another which dislodges the core placement arm cones 144 and 145 from the hollow ends of the core 70, allowing the core 70 with the flap 71 attached to be properly positioned between drive roll 122 and tuck roll 123 of the roll up 120. After the core placement arms 114 and 115 open and release the core 70 with the flap 71 attached so that it rests on top of the roll up 120 between drive roll 122 and tuck roll 123, the core placement head 116 rises to its home position of FIG. 7*a*, while concurrently rotating the core placement arms 114 and 115 clockwise via the cam arm 117. The core support arms 101 and 102 also rotate up to prepare for the next cycle of placing the flap on the core.

Figure 8:
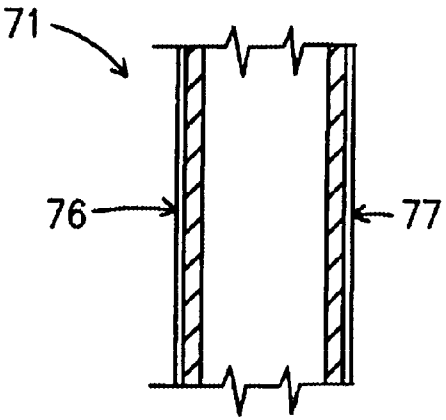
FIG. 8 illustrates the preferred interior surface of the flap.
Figure 9C:
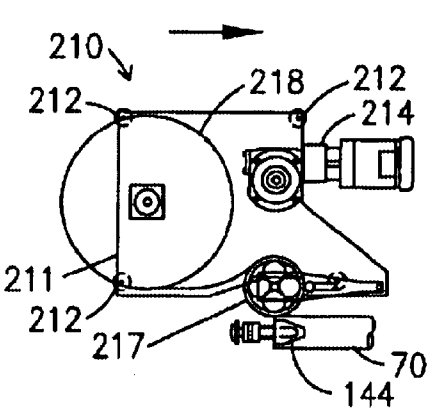
FIGS. 9(*a–g*, and *i*) are front views of the flap applicator of the present invention during one cycle of flap application as it travels across a core applying a flap and returns back to its home position.
Figure 9B:
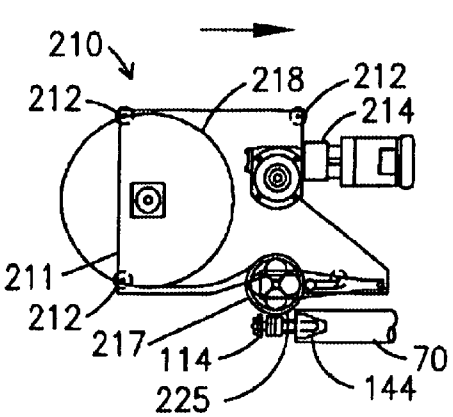
Figure 9A:
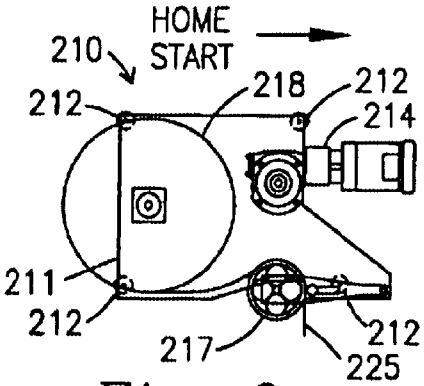
Figure 9E:
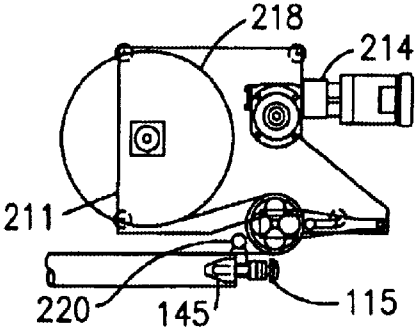
Figure 9D:
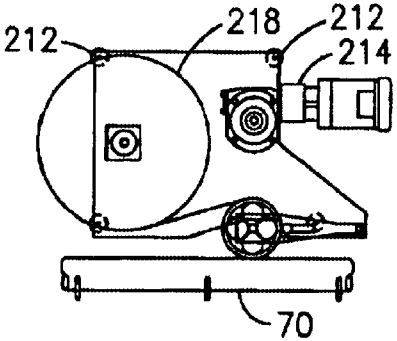
Figure 9F:
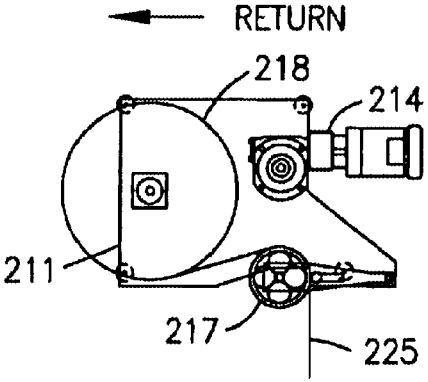
Figure 9G:
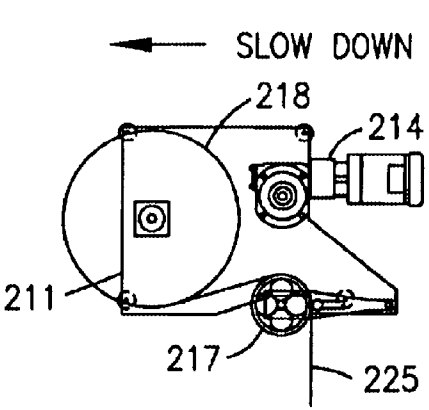
Figure 9H:
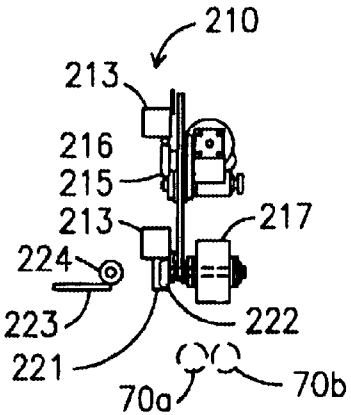
Figure 9I:
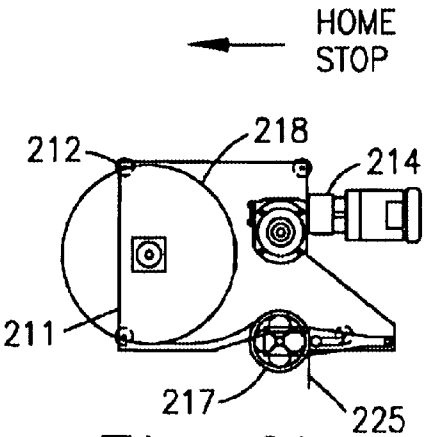
Figure 11C:
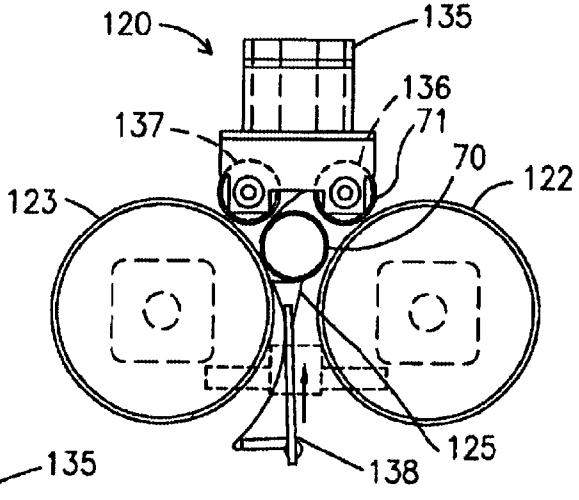
Figure 11B:
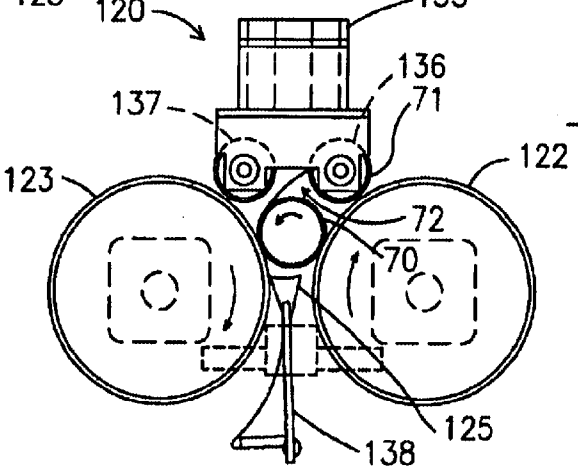
Figure 11A:
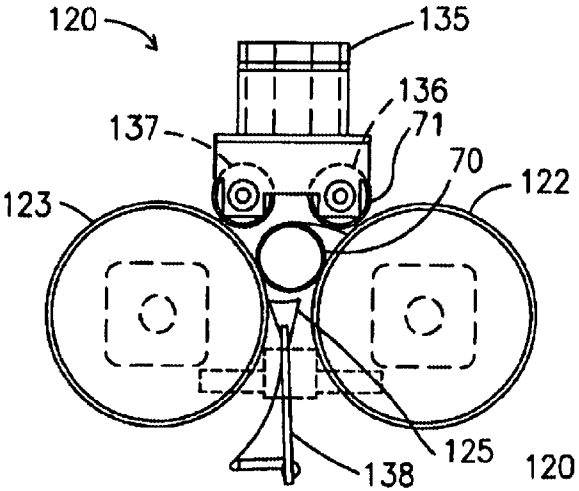
Figure 11F:
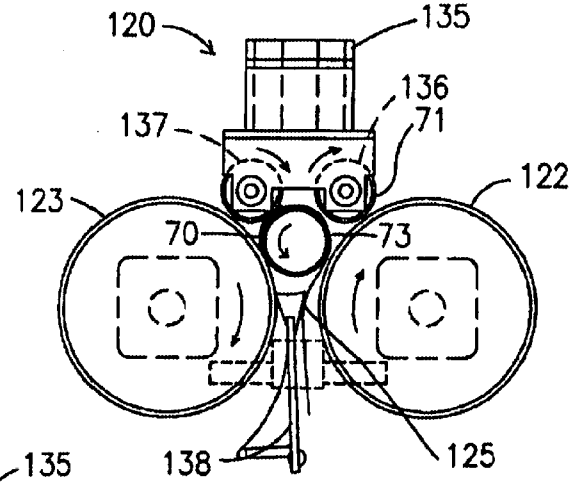
Figure 11E:
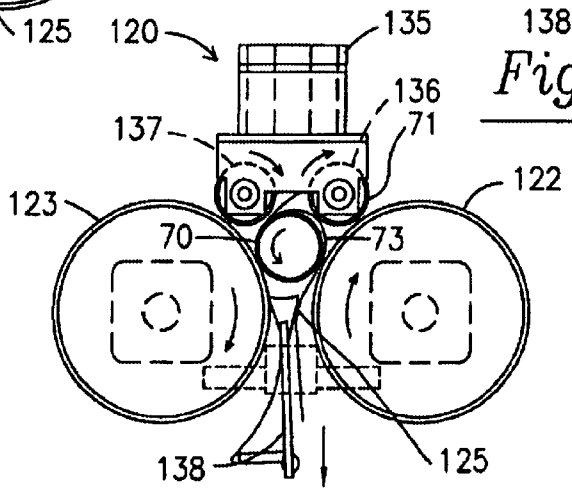
Figure 11D:
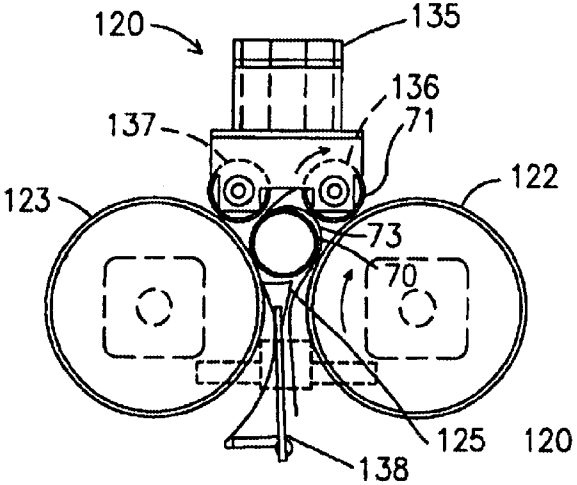

FIG. 8 illustrates the interior surface of the flap 71 of the present invention. The flap 71 is preferably a roll of paper or film ribbon applied across the length of the core 70. In the preferred embodiment, the flap 71 has a width wide enough to grasp the leading edge of carpet 73 or like material, typically approximately 4½ inches. An adhesive strip 76, 77 such as double coated pressure sensitive tape is applied to each side of the roll of flap material 218 along the length of its interior surface. Each adhesive strip 76, 77 is wide enough to adhere to the core 70, typically approximately ½ inch wide, and runs the entire interior length of the roll 218. Although it is preferable, it is not necessary to apply adhesive strips to each side of the length of flap 71. It is, however, necessary to have at least one adhesive strip so that the flap 71 will attach to the core 70. In the preferred embodiment, the roll 218 is a roll of 8 point card stock paper.

FIGS. 9(*a*–*i*) illustrate the flap applicator 210 during one cycle of flap application. Flap applicator carriage assembly 211 rides on carriage assembly wheels 212 via a frame and track assembly 213 driven by carriage drive unit 214 via a drive gear 215 and drive rack 216, shown in FIG. 9*h*. Flap applicator carriage assembly 211 carries a roll of flap material 218 which feeds flap material 225 onto flap applicator roll 217. The flap material 225 preferably has a strip of adhesive applied to each opposite side of the length of its interior surface, as shown in FIG. 8.

After the core 70 has been dispensed and sits in the nook 108 of the core support arms 101 and 102, and core placement arms 114 and 115 have closed in and centered core 70 by inserting core placement arm cones 144 and 145 in the hollow ends of the core 70, the flap applicator carriage assembly 211 of flap applicator 210 starts its travel internally relative to core 70 as shown in FIGS. 9(*a–e*). With the proper amount of flap material 225 extending from flap applicator roll 217, flap applicator roll 217 slides across the top of core 70 from first core placement arm 114 toward opposite core placement arm 115, until it reaches the end of the core 70. The flap applicator roll 217 is positioned so that it lies slightly lower than the core 70. As the flap applicator roll 217 makes contact with the core 70, the roll 218 dispenses the tape of flap material 225 which is sandwiched between the core 70 and the flap applicator roll 217 so that the adhesive along one edge of the interior surface of the tape 225 attaches to the core 70. The adhesive on the edge of the tape 225 bonds to the core 70 as the flap applicator roll 217 rolls across the core 70 and the opposite edge of the tape 225 forms the flap 71 on the core.

As previously discussed, if the flap applicator 210 is positioned above the core 70 so that the tape 225 extending from the roll of flap 218 lies slightly toward the accumulation tables 170 and 175, the flap 71 will be applied to the core 70 so that the mouth of the flap 72 faces the accumulation tables 170 and 175, for use with carpet that is rolled pile-in. Thus in FIG. 9*h*, the upstream edge of tape 225 would be applied to a core 70, in the position of core 70*a* and the downstream edge of tape 225 would form the flap 71 facing the accumulation tables 170, 175 downstream. If the flap applicator 210 is positioned above core 70 so that the tape 225 extending from the roll of flap 218 lies slightly upstream toward the squaring table 81, the flap 71 will be applied to a core 70 in the position of core 70*b* in FIG. 9*h* so that the mouth of the flap 72 faces upstream toward the squaring table, for use with carpet that is rolled pile-out.

As shown in FIGS. 9(*b–d*), as the carriage assembly 211 continues to travel, the tape is pulled off of the roll 218 and applied to the core 70 as flap 71. In FIG. 9(*e*), as the carriage assembly 211 approaches the end of core 70, the carriage assembly 211 slows and stops at a precise position relative to the end of core 70. A flap cut off knife 220 that is attached to core placement arm 115 is activated and cuts the paper 225 at the end of core 70, thus completing the flap application process by forming a flap 71 on the core 70.

After the core 70 with the flap 71 attached is lowered into the roll up 120, as previously discussed, the flap applicator carriage assembly 211 begins its return to its home position, as shown in FIG. 9(*f*). At this point, the length of the remaining tape 225 extending from the flap applicator roll 217 is too long to properly start the next cycle of flap application.

As the carriage assembly 211 approaches its home position, as shown in FIG. 9(*g*), it slows and a flap return gear 221, having a one-way clutch, engages into a return gear rack 222, shown in FIG. 9(*h*), rotating the applicator roll 217 counter-clockwise, thus pulling up the remaining paper 225 to the proper start length for the next cycle. FIG. 9(*h*) shows the end view of the flap applicator 210 as it completes one cycle of applying a flap 71 to the core 70. FIG. 9(*i*) illustrates the flap applicator 210 as it comes to a stop and returns to its home position for the next cycle of flap application.

Application of the flap 71 to the core 70 determines whether the core 70 is suitable for carpet to be rolled "pile-in" or "pile-out." Because the flap 71 has two adhesive strips 76 and 77 along its interior surface, it can be attached to the core 70 along the length of either adhesive strip 76 and 77. FIGS. 10(*a*) and 10(*b*) illustrate the end view of the core 70 with the flap 71 attached so that the carpet may be rolled either "pile-in" or "pile-out" depending on what is desired. If "pile-in" carpet is desired, the flap 71 is attached to the core 70 so that the mouth of the flap 72 faces downstream toward the accumulation tables 170 and 175, as shown in FIGS. 10(*a*) and 11(*a–f*). This is accomplished by positioning the flap applicator 210 above the core 70 so that the tape extending from the roll 218 lies downstream slightly toward the accumulation tables 170 and 175. As shown in FIG. 10(*b*), if the flap 71 is attached to the core 70 so that the mouth of the flap 72 faces the squaring table 81, also shown in FIGS. 12(*a–f*), the carpet should be rolled around the core 70 "pile-out." This is accomplished by positioning the flap applicator 210 above the core 70 so that the tape extending from the roll 218 lies slightly upstream toward the squaring table 81.

FIGS. 11(*a–f*) and 12(*a–f*) illustrate one cycle of the roll up 120 after the flap 71 has been attached to the core 70 and the core 70 has been laid to rest on top of the roll up 120 between the drive roll 122 and tuck roll 123. Once the core 70 has been positioned, starting head 135 travels along starting head guide 139, shown in FIG. 3, until it rests on top of drive roll 122 and tuck roll 123.

With particular attention to FIGS. 11(*a–f*), the flap 71 has been applied to the core 70 in the direction shown in FIG. 10(*a*) so as to create a "pile-in" carpet roll 17. The roll up 120 positions the leading edge of the carpet 73 between the flap 71 and the core 70 and winds the carpet "pile-in" around the core 70. The roll up 120 comprises a drive roll 122 which is the controlling force behind the roll up 120 and a tuck roll 123 which is driven slightly faster than the drive roll 122 as the carpet is rolled around the core 70. As the drive roll 122 and tuck roll 123 rotate clockwise simultaneously, the flap 71 of the core 70 rotates to the proper position so that the interior surface of the flap 71 having adhesive and the mouth 72 of the flap face the drive roll 122. The roll up 120 also comprises a turning bar 125 mounted above a lift pan 138, positioned between the drive roll 122 and the tuck roll 123. As shown in FIG. 11(*c*), the turning bar 125 and lift pan 138 lift the core 70 with the flap 71 attached off of the drive roll 122, in order to position the core 70 and the flap 71 to receive the leading edge of the carpet 73. The turning bar 125 and the lift pan 138 also guide the carpet as it is being fed into the roll up 120 in the proper orientation for pile-in or pile-out carpet. As shown in FIG. 11(*d*) when the drive roll 122 rotates, the leading edge of the carpet 73 is fed into the mouth 72 of the flap 71 between the flap 71 and the core 70. The leading edge of the carpet 73 may stick to adhesive on the interior surface of the flap 71. Then the turning bar 125 is lowered as shown in FIG. 11(*e*) and the roll up 120 winds the rest of the carpet around the core 70.

In FIG. 11(*a*), core 70 with flap 71 applied has been placed in the roll up 120 between the drive roll 122 and tuck roll 123, with the mouth of the flap 72 facing the accumulation tables 170 and 175. Starting head 135 has been placed into position so that the leading starting roll 136 is located above the drive roll 122 and trailing starting roll 137 is located above the tuck roll 123.

FIG. 11(*b*) shows drive roll 122 and tuck roll 123 rotating clockwise simultaneously, hence, rotating core 70 with flap 71 counter-clockwise, positioning flap 71 at a predetermined position. This predetermined rotational position may be at various locations depending on characteristics of flap 71 and the flexible material to be rolled.

Next, in FIG. 11(*c*), lift pan 138 and turning bar 125 are raised vertically, lifting core 70 with flap 71 off of drive roll 122 while permitting core 70 to remain in contact with tuck roll 123.

FIG. 11(*d*) shows drive roll 122 and leading starting roll 136 rotated clockwise simultaneously as the leading edge of the carpet 73, entering roll up 120 along lift pan 138 and turned by turning bar 125, is forced against the drive roll 122 and upwards against leading starting roll 136 to a position between the core 70 and flap 71. The leading edge of the carpet 73 being driven by drive roll 122 is forced against the leading starting roll 136 which rotates clockwise, hence, turning the leading edge of the carpet 73 into the mouth 72 and between core and flap 71. Drive roll 122 carrying the leading edge of the carpet 73 begins to press core 70 against non-rotating tuck roll 123.

In FIG. 11(*e*), the leading edge of the carpet 73 has been positioned in the mouth 72 between flap 71 and core 70, as previously described. With the drive roll 122 and leading starting roll 136 still rotating clockwise, tuck roll 123 and trailing starting roll 137 begin to rotate clockwise and lift pan 138 with turning bar 125 lowers to home position.

FIG. 11(*f*) shows drive roll 122, tuck roll 123, and starting rolls 136 and 137 all rotating clockwise causing the leading edge of the carpet 73 which is tucked securely between the core 70 and the flap 71 to rotate counter-clockwise. Starting head 135, being counter balanced with air pressure, floats vertically as the roll increases in diameter. After the roll increases to a predetermined diameter, the starting head 135 rises off the carpet roll 17 and is removed sideways along a starting head guide 139, shown in FIGS. 7(*a–d*),) to allow the carpet roll 17 to increase in diameter.

Figure 12F:
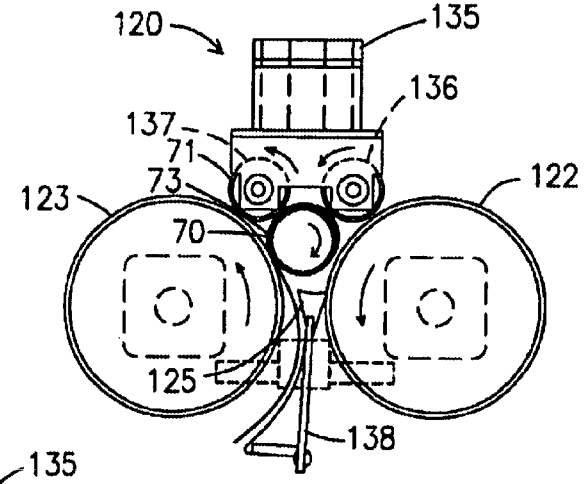
FIGS. 12(*a–f*) are side views of the roll up of the present invention showing one cycle of rolling a carpet around a core with a flap, showing the carpet rolled pile-out.
Figure 12E:
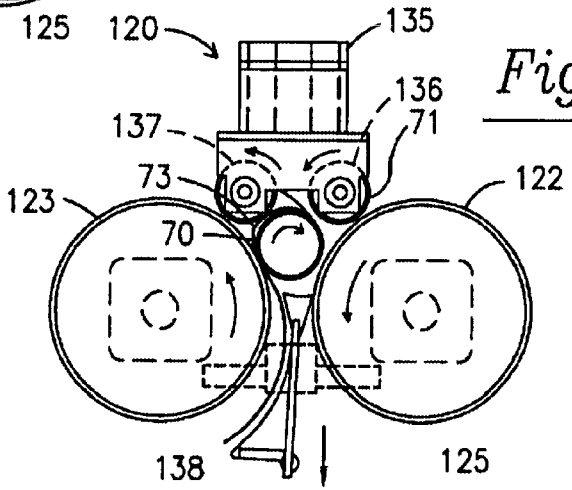
Figure 12D:
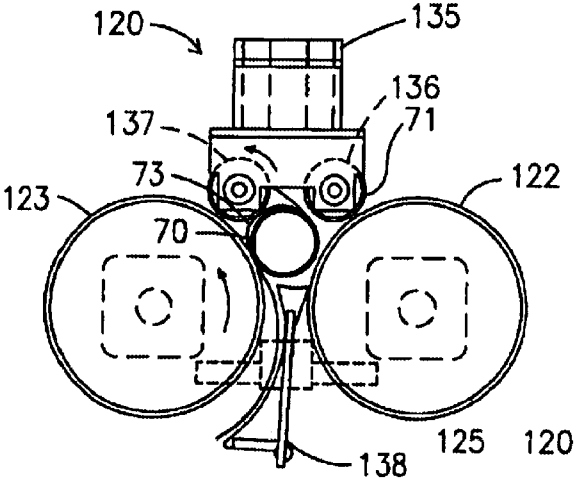

FIGS. 12(*a–f*) illustrate one cycle of the roll up 120 with the flap 71 applied to the core 70 according to FIG. 10(*b*) so as to create a "pile-out" carpet roll 17. The roll up 120 positions the leading edge of the carpet 73 between the flap 71 and the core 70 and winds the carpet "pile-out" around the core 70. In order to accomplish the winding of the carpet "pile-out" around the core 70, the drive roll 122 and the tuck roll 123 exchange functions so that the drive roll 122 is driven slightly faster than the tuck roll 123 and the tuck roll 123 is the controlling force behind the roll up 120. Moreover, leading starting roll 136 and trailing starting roll 137 also exchange functions so that the trailing starting roll 137 pushes the upwardly directed carpet onto the core. In order to guide the leading edge of the carpet 73 to the correct orientation to produce a "pile-out" carpet roll 17, turning bar 125 and lift pan 138 are also rotated clockwise away from the tuck roll 123 and into the drive roll 122. This action causes the leading edge of the carpet 73 to be fed in the proper orientation in the mouth 72 of the flap 71 so as to produce a "pile-out" carpet roll 17.

In FIG. 12(*a*) core 70 with flap 71 applied has been placed on the roll up 120 between the drive roll 122 and tuck roll 123, with the mouth 72 facing the squaring table 81 in order to wind the carpet "pile-out" around core 70. Starting head 135 has then been placed into position so that the leading starting roll 136 is located above the drive roll 122 and trailing starting roll 137 is located above the tuck roll 123.

FIG. 12(*b*) shows drive roll 122 and tuck roll 123 rotating counter-clockwise simultaneously, hence, rotating core 70 with flap 71 clockwise, positioning flap 71 at a predetermined position. This pre-determined rotational position may be at various locations depending on characteristics of flap 71 and the flexible material to be rolled.

Next in FIG. 12(*c*), lift pan 138 with turning bar 125 are raised vertically, lifting core 70 with flap 71 off of tuck roll 123 while permitting core 70 to remain in contact with drive roll 122.

FIG. 12(*d*) shows tuck roll 123 and trailing starting roll 137 rotated counterclockwise simultaneously as the leading edge of the carpet 73, entering roll up 120 along lift pan 138 and turned by turning bar 125, is forced against the tuck roll 123 and upwards into starting roll 137 which rotates counter-clockwise and hence over to a position in the mouth 72 between the core 70 and flap 71. Tuck roll 123 carrying the leading edge of the carpet 73 begins to press core 70 against non-rotating drive roll 122.

In FIG. 12(*e*), the leading edge of the carpet 73 has been positioned between flap 71 and core 70 as described. With the tuck roll 123 and trailing starting roll 137 still rotating counter-clockwise, drive roll 122 and leading starting roll 136 begin to rotate counter-clockwise and lift pan 138 with turning bar 125 lower to home position.

FIG. 12(*f*) shows drive roll 122, tuck roll 123 and starting rolls 136 and 137 all rotating counter-clockwise and the leading edge of the carpet 73, which is tucked securely between the core 70 and flap 71, rotates clockwise. Starting head 135 being counter-balanced with air pressure floats vertically as the roll increases in diameter. After the roll increases to a predetermined diameter, the starting head 135 rises off the carpet roll 17 and is removed sideways along the starting head guide 139, shown in FIGS. 7(*a–d*), to allow the carpet roll 17 to increase in diameter. At approximately the same time, anti-telescoping arms 112, 113, shown in FIGS. 3 and 6, move into position. These arms ensure that the carpet is wound concentrically on roll 70 rather than telescoping toward either end of the roll.

Returning now to FIG. 3, once the proper amount of carpet has been measured and wound around the core 70 the carpet hold down bar 84 is lowered to secure the carpet while the dual sheer cross cutter 90 cuts the carpet along its width. Once the trailing edge of the carpet is completely rolled around the core 70, the anti-telescoping arms 112 and 113 of the anti-telescoping system 110 lift and swing away from the carpet roll 17 on the roll up 120. The starting head 135, which was previously removed along starting head guide 139, is once more directed outward along the starting head guide 139 toward the roll up 120. The starting head 135 pushes against the finished carpet roll 17, causing it to roll onto ramp 223. The downward slope of ramp 223 directs the carpet roll 17 on top of the first accumulator table 170 shown in FIGS. 1 and 4. The first accumulation table 170 carries the carpet roll 17 to a second accumulation table 175 and finally to wrapping station 180, shown in FIGS. 1 and 5, where the carpet roll 17 is secured as with a protective wrapper and binding material, such as tape, to maintain the carpet roll 17 securely. The roll 17 is then transferred to a take away conveyor 195 shown in FIGS. 1 and 5.

The carpet rolling machine of the present invention is powered by motor and controlled by an operator through manual actuation of switches. The carpet rolling machine of the present invention can also be connected to an automated controller to perform sequences of action automatically, however, it is preferred that the apparatus operate with human supervision.

What is claimed is:

1. A device for winding an elongate strip of flexible material having a leading edge around a roll, said device comprising a flap applicator which applies a flap to a core; and a roll up which feeds the leading edge of the flexible material between the flap and the core and winds the elongate strip of flexible material around the core; wherein the flap applicator comprises:

(a) a carriage assembly which rides on wheels via a frame and track assembly;

(b) a carriage drive unit which drives the carriage via a drive gear and drive rack;

(c) a roll of tape connected to the flap applicator carriage assembly which feeds the flap onto a flap applicator roll which moves across the length of the core applying the flap to the core; and (d) a pair of actuators which retract to move the position of a pair of linkages attached to frame and track attachment arms, thereby moving the applicator across the width of the core.

2. The device of claim 1, wherein the flap applicator further comprises a flap cut off apparatus.

3. A device for winding an elongate strip of flexible material having a leading edge around a roll, said device comprising a flap applicator which applies a flap to a core; and a roll up which feeds the leading edge of the flexible material between the flap and the core and winds the elongate strip of flexible material around the core; where the roll up comprises:

(a) a drive roll and a tuck roll which hold the core with the flap attached;

(b) a starting head which travels along a starting head guide until it rests on top of the drive roll and tuck roll;

(c) a turning bar mounted above a lift pan, positioned between the drive roll and the tuck roll, which positions the core and the flap to receive the leading edge of the flexible material and guides the flexible material as it is being fed into the q roll up.

4. A rolling machine having a loading deck, a frame over a cutting table, and a flap core positioning system comprising:

(a) a core dispenser mounted to the frame;

(b) a core placement arm mounted to a core placement head; and (c)a flap applicator mounted proximate to the core placement head.

5. The rolling machine of claim 4 further comprising a roll-up apparatus comprising:

(a) a drive roll and tuck roll;

(b) a starting head movable to a position above a core resting on the drive roll and tuck roll; and (c) a turning bar mounted above a lift pan positioned between the drive roll and tuck roll.

6. A method for winding an elongate strip of flexible material into a roll around a core with a flap attached, said method comprising:

(a) attaching a flap to a core by moving a flap applicator along the length of the core;

(b) inserting a leading edge of the flexible material between the flap and the core by:

(i) positioning the core with flap attached on a drive roll and a tuck roll of a roll up;

(ii) raising a turning bar to lift the core off at least one of the drive roll and the tuck roll;

(iii) moving a starting head into position above the core; and (iv) feeding the leading edge of the flexible material into the roll up and across the turning bar; and (c) rolling the material around the core.

7. The method according to claim 6 wherein the turning bar is adjustable between a first position adapted to feed the leading edge counterclockwise around the core and a second position adapted to feed the leading edge clockwise around the core, thereby permitting the flexible material to be selectively wound about the core in either face-in or face-out orientation.

8. In a rolling machine of the type having a squaring table, a core dispenser and a roll up, a flap applicator comprising:

(a) a lateral track;

(b) a laterally moveable carriage assembly connected to the lateral track holding a roll of tape with a fastening mechanism;

(c) a tape cutter; and (d) a longitudinally adjustable linkage connected to said lateral track.

9. The rolling machine of claim 8 wherein the longitudinally adjustable linkage is movable from a first position to attach a first edge of the roll of tape to a core for rolling a flexible-material on the core in face-in orientation to a second position to attach a second edge of the roll of tape to a core for rolling the flexible material on the core in face-out orientation.

10. A method of winding flexible material about a core in a rolling machine of the type having a squaring table, a core dispenser, and a roll up with a drive roll, a tuck roll, and a turning bar comprising the steps of:

(a) dispensing a core;

(b) positioning said core having a flap over the drive roll and the tuck roll;

(c) positioning the turning bar proximate the tuck roll and beneath the core;

(d) feeding a leading edge of the flexible material into the roll up, and upwards between the drive roll and the turning bar;

(e) continuing to feed the leading edge of the flexible material into a mouth formed between the flap and the core;

(f) driving the drive roll and the tuck roll in the same direction to wind the flexible material about the core.

11. The method of claim 10 further comprising the step of applying a tape with an adhesive to the core to form a flap on the core, after the core is dispensed.

12. A roll up for winding an elongate strip of flexible material comprising:

(a) a drive roll;

(b) a tuck roll extending parallel to the drive roll and having a space there between;

(c) a turning bar extending parallel to the drive roll and being moveable in a vertical direction within the space and being moveable in a horizontal direction from a first position proximate the drive roll to direct the elongate strip to contact the tuck roll to a second position proximate the tuck roll to direct the elongate strip to contact the drive roll;

(d) a starting head moveable from an operating position over and proximate to the drive roll and tuck roll, to a resting position relatively distal from the drive roll and tuck roll.

* * * * *